US011874001B1

(12) United States Patent
Tartakovsky

(10) Patent No.: US 11,874,001 B1
(45) Date of Patent: Jan. 16, 2024

(54) TEMPERATURE CONTROL SYSTEM

(71) Applicant: Epic Systems, LLC, San Francisco, CA (US)

(72) Inventor: Igor Tartakovsky, San Francisco, CA (US)

(73) Assignee: EPIC SYSTEMS, LLC, San Francisco, CA (US)

( * ) Notice: Subject to any disclaimer, the term of this patent is extended or adjusted under 35 U.S.C. 154(b) by 226 days.

(21) Appl. No.: 16/658,927

(22) Filed: Oct. 21, 2019

Related U.S. Application Data

(60) Provisional application No. 62/748,814, filed on Oct. 22, 2018.

(51) Int. Cl.
*F24F 1/0047* (2019.01)
*F24F 1/64* (2011.01)

(52) U.S. Cl.
CPC ..... *F24F 1/0047* (2019.02); *F24F 1/64* (2013.01)

(58) Field of Classification Search
CPC ..... F24F 1/0047; F24F 1/64; F24F 1/0003; F24F 2221/14; F24F 2221/36; F25B 2339/047
See application file for complete search history.

(56) References Cited

U.S. PATENT DOCUMENTS 2,770,955 A * 11/1956 Lundstrum ..... F24F 1/0047 454/343
4,702,087 A * 10/1987 Nakajima ..... F24F 13/32 62/285
4,766,735 A * 8/1988 Gotou ..... F25B 5/00 62/175
4,828,171 A 5/1989 Akin, Jr. et al.
5,161,386 A * 11/1992 Higuchi ..... F25B 13/00 62/238.7
6,260,373 B1 * 7/2001 Rockwood ..... F24F 1/029 62/295
9,528,769 B2 * 12/2016 Sakashita ..... F24F 1/0047
9,551,514 B2 * 1/2017 Tartakovsky ..... F24F 13/28
2015/0292778 A1 * 10/2015 Tartakovsky ..... F24F 1/0003 62/324.1
2017/0130972 A1 5/2017 Tartakovsky et al.

OTHER PUBLICATIONS

Unitary Products Group, KPH Ceiling Mounted Ducted Condensing Units Installation and Operation, Instructionshttps://www.skymarkinternational.com/website_pdf/product4/prod3/145.28-IOM1.pdf, 2008, Johnson Controls, p. 1 (Year: 2008).*
Rigid Technology, https://www.rigidhvac.com/dc-condensing-unit, Oct. 20, 2018, Rigid HVAC Co. Ltd, pp. 1-2 (Year: 2018).*

* cited by examiner

*Primary Examiner* — Schyler S Sanks
(74) *Attorney, Agent, or Firm* — Wilson Sonsini Goodrich & Rosati

(57) ABSTRACT

A compact temperature control system is provided for use within a building. The temperature control system may be designed with a floor-saving design that causes a condenser unit (CU) and a fan coil unit (FCU) to be supported at or near the ceiling. The temperature control system may allow for multi-zone temperature control by connecting multiple FCUs to a CU.

20 Claims, 7 Drawing Sheets

TEMPERATURE CONTROL SYSTEM

CROSS-REFERENCE TO RELATED APPLICATIONS

This application claims the priority and benefit of U.S. Provisional Application No. 62/748,814 filed on Oct. 22, 2018, the entire contents of which are incorporated herein by reference.

BACKGROUND OF THE INVENTION

Temperature control systems can be used to heat up and/or cool the buildings. Temperature control systems for buildings can often be costly and take up large amounts of space. Oftentimes, heat pump units may take up a significant amount of space, which may be detrimental in buildings with limited space. Particularly in commercial and residential buildings, or any unit with limited square footage, the amount of space taken up by temperature control systems may limit the availability of usable space. In some instances, heat pumps may be stored in dedicated closets, which limit options in the building layout.

In some instances, split systems may be used. Split systems may utilize condenser units and fan-coil units. However, traditional water cooled split systems may still be relatively large and take up large amounts of space. For example, split systems may be installed within closets and take up a significant amount of space within the closet. Furthermore, split systems can take up a significant amount of floor space within the buildings' core, which is often of greater utility for other purposes.

SUMMARY OF THE INVENTION

A need exists for improved systems and methods of temperature control. A need exists for temperature control systems (e.g., HVAC systems) that can further save space by having a compact footprint and being installed in a manner that utilizes less often-used space near the ceiling plenum, and leaves space on the floor for other purposes. A further need exists for compact temperature control systems that allow for multi-zone temperature control from a single condensing unit.

A temperature control system may be provided, comprising a water-cooled condenser unit (CU) and one, two or more fan coil units (FCUs). The CU may be mounted anywhere within an installation floor, such as the floor or the ceiling, or a wall. The CU may advantageously be mounted in a top portion of the installation space, to allow a user to utilize the lower portion of the installation space for other purposes. This provides greater space saving and efficiency. The CU may be couple to a single FCU or multiple FCUs. Being coupled to multiple FCUs may advantageously allow for multiple temperature control zones. The FCUs may be capable of operating independently of one another.

Additional aspects and advantages of the present disclosure will become readily apparent to those skilled in this art from the following detailed description, wherein only exemplary embodiments of the present disclosure are shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

The invention provides systems and methods for temperature control of a building or portion of a building. Various aspects of the invention described herein may be applied to any of the particular applications set forth below. The invention may be applied as a combination of a condenser unit (CU) and a fan coil unit (FCU), or an integrated system for single or multi-zone temperature control. It shall be understood that different aspects of the invention can be appreciated individually, collectively or in combination with each other.

A temperature control system may be provided in accordance with embodiments of the invention. A temperature control system may be any system capable of controlling temperature within a space, such as a building, portion of a building, room, hallway, closet, or open area. A temperature control system may control heating and/or cooling of an area. A temperature control system may be a heating, ventilation and air conditioning (HVAC) system. The temperature control system may allow for desired air quality within the controlled space. The temperature control system may be able to meet desired energy efficiency levels. For instance, the temperature control system may be able to meet at least an EER rating of 10, 11, 11.5, 12, 13, 14, or 15. The temperature control system may be to meet at least a SEER rating of 13, 14, 15, or 16.

Figure 1:
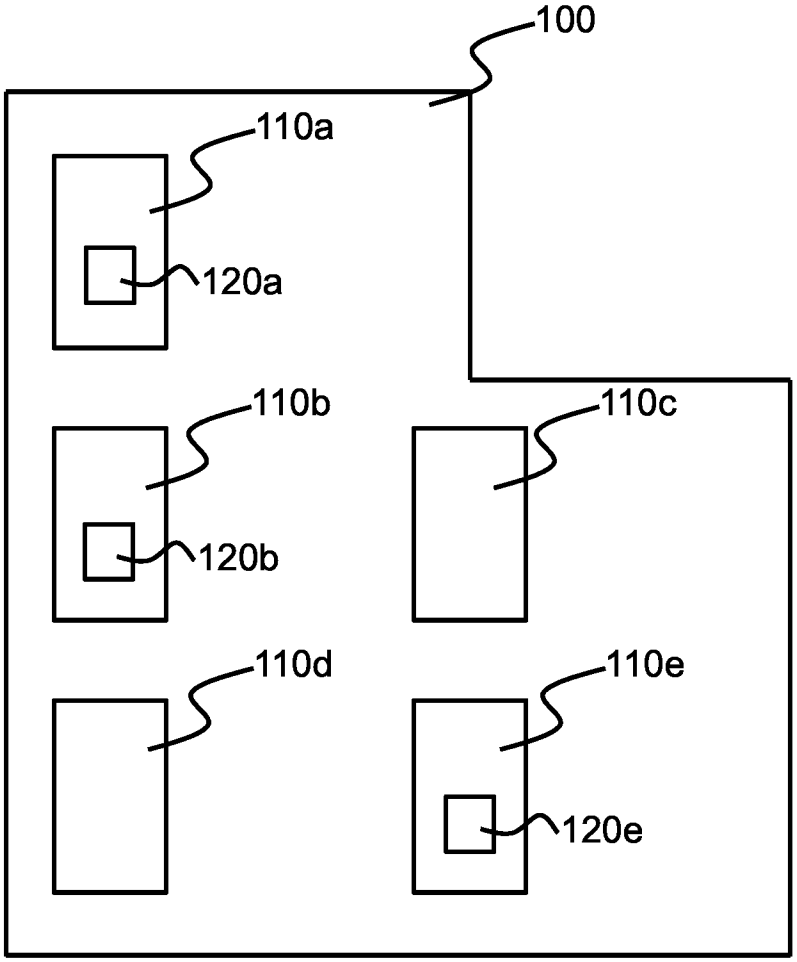
FIG. 1 shows an example of a building with multiple temperature control system installation spaces and temperature control systems, in accordance with embodiments of the invention.

FIG. 1 shows an example of a building 100 with temperature control system installation spaces 110*a-e* and temperature control systems 120*a*, 120*b*, 120*e*. Temperature control systems may be installed within an installation space. An installation space may be a portion of a room, within a closet, within a cabinet, within a hallway, within an attic, within a crawlspace, or any other portion of a building. In some examples, an installation space may be a dedicated closet to the temperature control system. In some examples, an installation space may be a closet which houses the temperature control system, and which can be used to house other items (e.g., storage for clothing, cleaning supplies, shoes, etc.). The installation space may be a clothing closet. The installation space may be a wall or a corner of a room. The temperature control system may control a controlled space within the building. The controlled space may oftentimes extend beyond the installation space. For example, the controlled space may be an apartment unit within a multi-residence building, and the installation space may be a closet of the apartment unit.

The building 100 may be a commercial building or a residential building. The building may comprise a single room or multiple rooms, or units. The building may comprise a single temperature control system or multiple temperature control systems. The building may be an apartment building, a high-rise building, an office building, a warehouse, a single-family building, a retail building, or any other type of building.

The temperature control system may be a split system. The temperature control system may or may not be a ductless system. The temperature control system may comprise at least one condenser unit (CU) and at least one fan control unit (FCU). In some embodiments, the temperature control system may be compact enough to be stored within a small space, such as a clothing closet. For example, in one embodiment, the CU may have dimensions of approximately 11 inches tall by 38 inches wide by 19 inches long. In another embodiment, the CU may have dimensions of approximately 11 inches deep by 38 inches wide by 19 inches tall. In various embodiments, the CU 310 may be connected to multiple FCUs.

The temperature control system, or any component of the temperature control system (such as the CU or the one or more FCUs, or the combination of both) may be compact enough to be stored within an area that has a footprint of less than or equal to 15 square feet, 14 square feet, 13 square feet, 12 square feet, 11 square feet, 10 square feet, 9 square feet, 8 square feet, 7 square feet, 6 square feet, 5 square feet, 4 square feet, 3 square feet, 2 square feet, 1 square foot, half a square foot, or a quarter of a square foot. The temperature control system, or any component of the temperature control system (such as the CU or the FCU, or the combination of both) may be compact enough to be stored within a volume of less than or equal to 100 cubic feet, 90 cubic feet, 80 cubic feet, 70 cubic feet, 60 cubic feet, 50 cubic feet, 40 cubic feet, 35 cubic feet, 30 cubic feet, 25 cubic feet, 20 cubic feet, 15 cubic feet, 12 cubic feet, 10 cubic feet, 9 cubic feet, 8 cubic feet, 7 cubic feet, 6 cubic feet, 5 cubic feet, 4 cubic feet, 3 cubic feet, 2 cubic feet, or 1 cubic foot. The temperature control system, or any component of the temperature control system (such as the CU or the FCU, or the combination of both) may be compact enough to be stored within a region that has a height of less than or equal to 2 feet, 1.5 feet, 1 foot, 11 inches, 10 inches, 8 inches, 6 inches, 4 inches, or 2 inches.

The temperature control system may have a maximum capacity of 3 tons of cooling and/or heating or less. The temperature control system may have a maximum capacity of 3, 2.5, 2, 1.5, 1, or 0.5 tons of cooling or less. The temperature control system may be able to provide at least any value for cooling stated herein.

Figure 2:
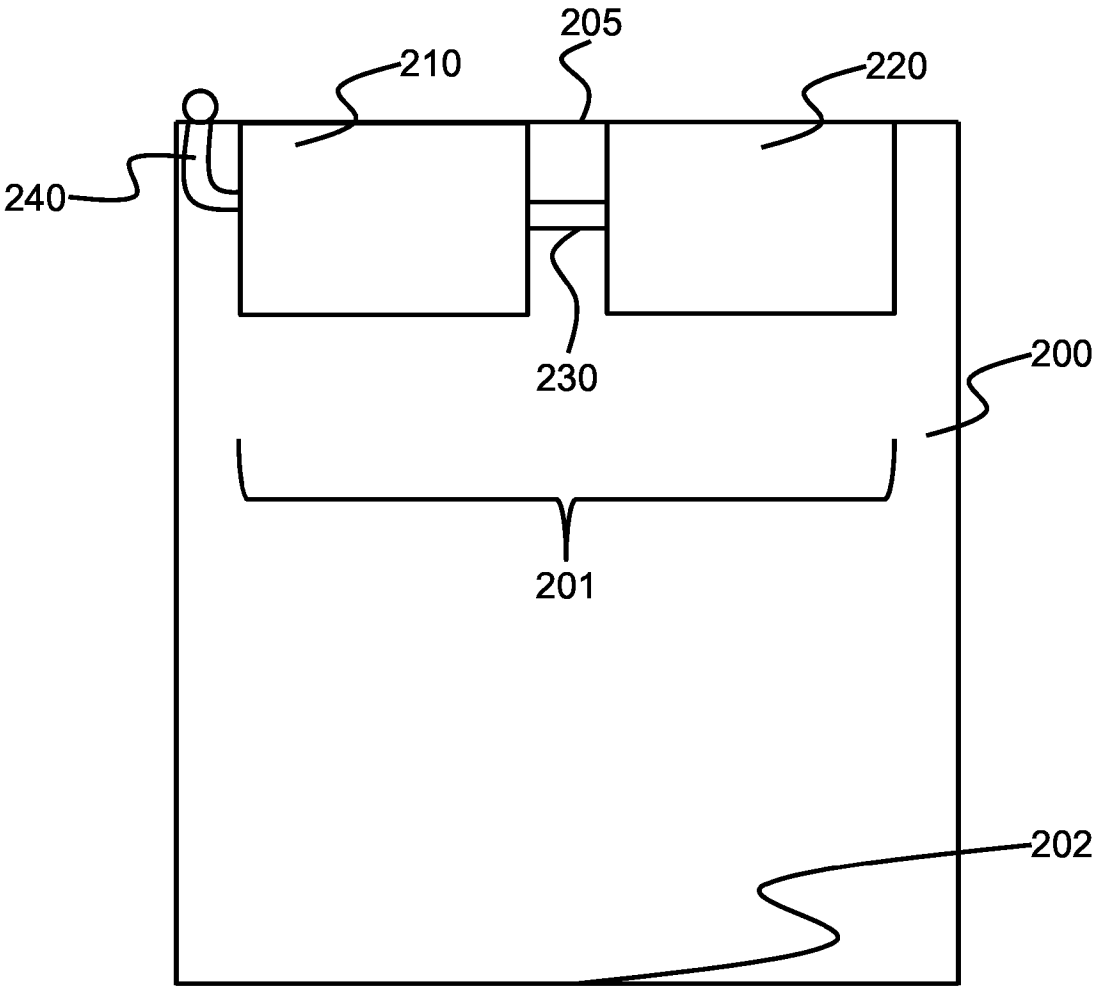
FIG. 2 shows an example of an installation space with a floor-saving temperature control system, in accordance with embodiments of the invention.

FIG. 2 shows an example of an installation space 200 with a floor-saving temperature control system 201.

The installation space 200 may include a top surface 205, such as a ceiling. The top surface may be flat or may be sloped. One or more walls or beams may support or meet the top surface. In one example, the installation space may be a closet, such as a clothing closet.

The temperature control system 201 may comprise a CU 210 and a FCU 220. The CU and FCUs may be joined by a connector 230.

The CU 210 may be located within an installation space. In some embodiments, the CU may be located at or near a top region of the installation space. The CU may be supported by a ceiling of the installation space. The CU may be directly coupled to and/or contacting the ceiling. The CU may be supported by one or more fasteners to the ceiling, or one or more intermediary objects connected to the ceiling. One or more brackets or protruding portions may aid in the connection of the CU to the ceiling or an intermediary object. The ceiling may bear some or all of the weight of the CU. The CU may be located near the ceiling. The CU may be within 1 foot, 10 inches, 8 inches, 6 inches, 4 inches, 2 inches, or 1 inch of the ceiling. The CU may be attached to an upper portion of a wall at or near a ceiling. The CU may or may not be located where a wall may meet the ceiling. The wall may bear some or all the entirety of the weight of the CU. The CU may be located within the top 50%, 40%, 30%, 25%, 20%, 15%, 10%, 7%, 5%, 3%, 1%, or 0.1% of the installation space (e.g., closet or room).

The CU may be connected to one or more water lines 240. The water lines may flow within the building to deliver water from a source within or outside the building. The water lines may deliver water to the CU. The water lines may deliver any kind of cooling fluid.

The FCU 220 may be located within an installation space. In some embodiments, the FCU may be located at or near a top region of the installation space. The FCU may be supported by a ceiling of the installation space. The FCU may be directly coupled to and/or contacting the ceiling. The FCU may be supported by one or more fasteners to the ceiling, or one or more intermediary objects connected to the ceiling. The FCU may be attached to the ceiling or intermediary object with aid of one or more brackets or other connectors. The ceiling may bear some or all of the weight of the FCU. The FCU may be located near the ceiling. The FCU may be within 1 foot, 10 inches, 8 inches, 6 inches, 4 inches, 2 inches, or 1 inch of the ceiling. The FCU may be attached to an upper portion of a wall at or near a ceiling.

The FCU may or may not be located where a wall may meet the ceiling. The wall may bear some or all the entirety of the weight of the FCU. The FCU may be located within the top 50%, 40%, 30%, 25%, 20%, 15%, 10%, 7%, 5%, 3%, 1%, or 0.1% of the installation space (e.g., closet or room).

The CU 210 may be coupled to the FCU 220 with aid of a connector 230. The connector may comprise one or more lines, such as one or more tubes. The connector may optionally be flexible. The connector may comprise one or more refrigeration lines. The connector may or may not traverse the ceiling of the installation space.

Having both a CU and FCU located at or near a ceiling of the installation space may advantageously allow a large amount of floor space 202 to be open. This may be advantageous in clothing closets or other types of installation spaces, since many objects end up on the floor of closets. Oftentimes, many objects are not provided at the top of closets, so this allows the temperature control system to be advantageously stored in space that is traditionally underutilized.

Further possible details of CUs and FCUs are provided elsewhere herein. Such details are provided by way of example only and are not limiting.

Figure 3:
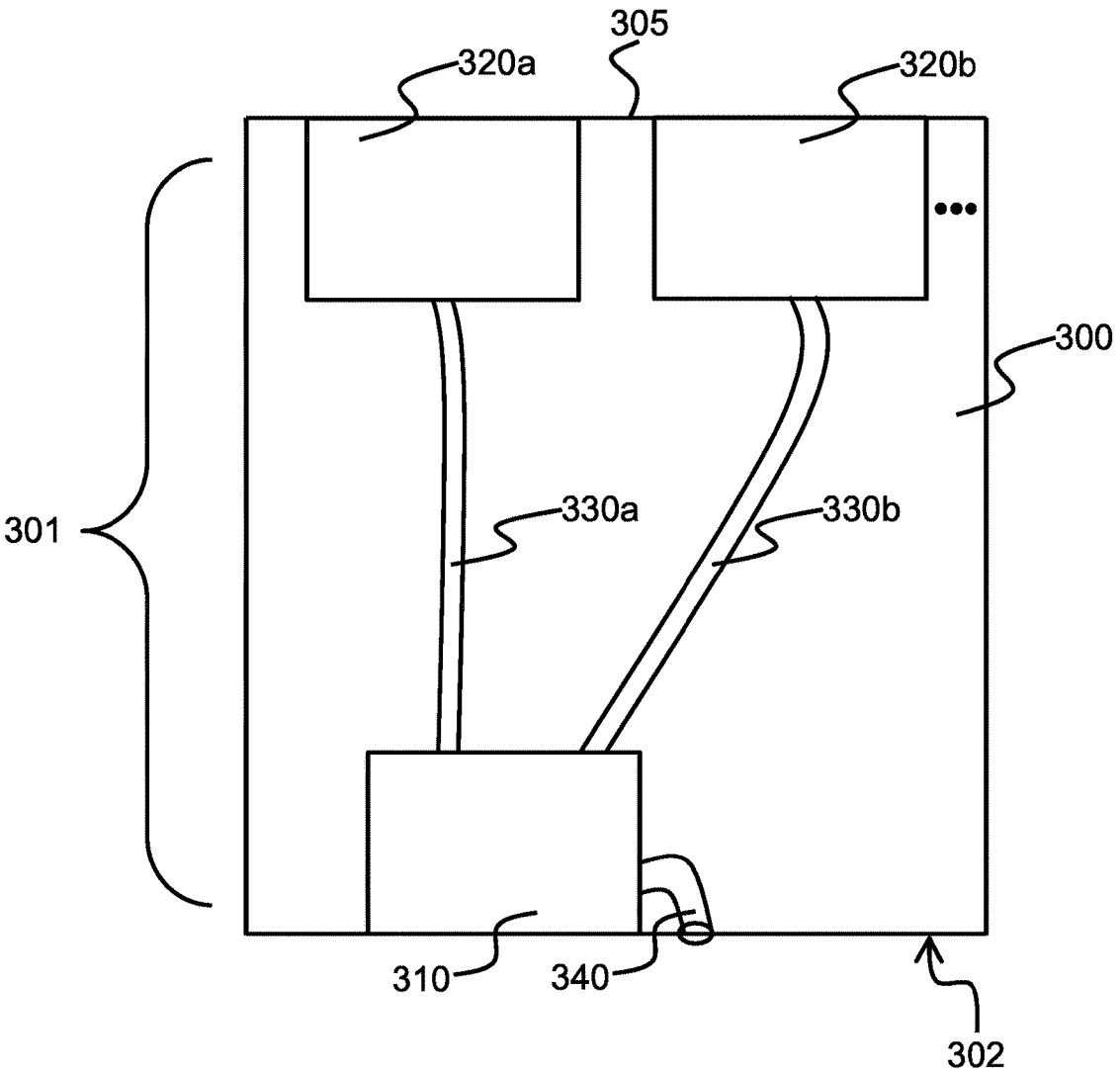
FIG. 3 shows an example of an installation space with a multi-zone temperature control system, in accordance with embodiments of the invention.

FIG. 3 shows an example of an installation space 300 with a multi-zone temperature control system 301.

The installation space 300 may include a top surface 305, such as a ceiling. The top surface may be flat or may be sloped. One or more walls or beams may support or meet the top surface. In one example, the installation space may be a closet, such as a clothing closet. The installation space may include a lower surface 302 such as a floor.

The temperature control system 301 may comprise a CU 310 and a plurality of FCUs 320*a*, 320*b*. The condenser and FCUs may be joined by respective connectors 330*a*, 330*b*.

The CU 310 may be located within an installation space. In some embodiments, the CU may be located at or near a top region of the installation space. The CU may be located at or near a bottom region of the installation space. For example, the CU may be resting on the bottom surface of the installation space. The CU may be sitting on the floor of the installation space. The floor may bear the weight of some or the entirety of the CU. The CU may be at or near a wall of the installation space. In some instances, the CU may be at a location where a wall meets the floor. The CU may optionally be mounted anywhere on a wall of the installation space. The wall may bear weight of some or the entirety of the CU.

The CU may be connected to one or more water lines 340. The water lines may flow within the building to deliver water from a source within or outside the building. The water lines may be directly or indirectly coupled to a water main. The water lines may deliver water to the CU. The water lines may deliver any kind of cooling fluid.

The FCUs 320*a*, 320*b* may be located within an installation space. The FCU may be located within an upper portion of the installation space or lower portion of the installation space. The FCU may be located on a floor or at a ceiling, or on a wall.

In some embodiments, the FCUs may be located at or near a top region of the installation space. The FCUs may be supported by a ceiling of the installation space. The FCUs may be directly coupled to and/or contacting the ceiling. The FCUs may be supported by one or more fasteners to the ceiling, or one or more intermediary objects connected to the ceiling. The ceiling may bear some or all of the weight of the FCUs. The FCUs may be located near the ceiling. The FCUs may be within 1 foot, 10 inches, 8 inches, 6 inches, 4 inches, 2 inches, or 1 inch of the ceiling. The FCUs may be attached to an upper portion of a wall at or near a ceiling. The FCUs may or may not be located where a wall may meet the ceiling. The wall may bear some or all the entirety of the weight of the FCUs. The FCUs may be located within the top 50%, 40%, 30%, 25%, 20%, 15%, 10%, 7%, 5%, 3%, 1%, or 0.1% of the installation space (e.g., closet or room). The FCUs may be adjacent to one another. The FCUs may or may not come into contact with one another. In some instances, the FCUs may have sufficient space between one another to not vibrate against or bump into one another. For example, a gap of at least 1, 2, 3, 4, 5, 6, 7, 8, 9, 10, or more inches may be provided between FCUs. In some instances, the FCUs may be sufficiently close together to provide a compact arrangement. The distance between FCUs may be less than any of the values provided herein. The FCUs may be provided in a row. The FCU positions relative to one another may depend on a configuration of the installation space.

Two FCUs are illustrated by way of example. However, any number of FCUs may be provided for the temperature control system. For example, two or more, three or more, four or more, five or more, six or more, seven or more eight or more, or ten or more FCUs may be provided as part of the temperature control system. The FCUs may be connected to a single CU. Alternatively, multiple FCUs may be connected to multiple CUs. A condenser unit of the temperature control system may be coupled to two or more FCUs.

Each FCU may comprise its own fan. Each FCU may have one or more fans. The fan of each FCU may be capable of operating independently of fans of other FCUs. For example, a fan of a first FCU may operate independently of a fan of a second FCU. The FCUs may operate independently of one another. This may allow for multiple temperature zones within a region that is heated or cooled by the temperature control system. Each FCU may correspond to a region of a space that is heated or cooled by the temperature control system. Thus, a single condenser unit may be able to support multiple FCUs, and thereby support multiple temperature zones. A user may be able to individually specify and control the temperature in the different temperature zones. For example, a user may set a first temperature range for a first temperature zone that is controlled by a first FCU, and a user may set a second temperature range for a second temperature zone that is controlled by a second FCU.

The CU 310 may be coupled to each of the FCUs 320 with aid of respective connectors 330*a*, 330*b*. Each connector may comprise one or more lines, such as one or more tubes. The connector may optionally be flexible. The connector may comprise one or more refrigeration lines. In some instances, each FCU may have its own connector to the CU. The connectors may optionally traverse a wall or ceiling or floor of the installation space.

Having both a compact temperature control system with multiple FCUs may advantageously allow a user to individual control multiple zones. For example, within an apartment, a user may specify a first temperature zone in a common area while specifying a second temperature zone in a bedroom. This may be advantageous in allowing a user to save energy (e.g., not needing to heat or cool a section that the user is not occupying) or provide customization (e.g., user likes to keep the user's bedroom warm when sleeping but likes the common space to be cool). The compact system allows the temperature control system to take up relatively little space within the building.

Further possible details of CUs and FCUs are provided elsewhere herein. Such details are provided by way of example only and are not limiting.

Figure 4:
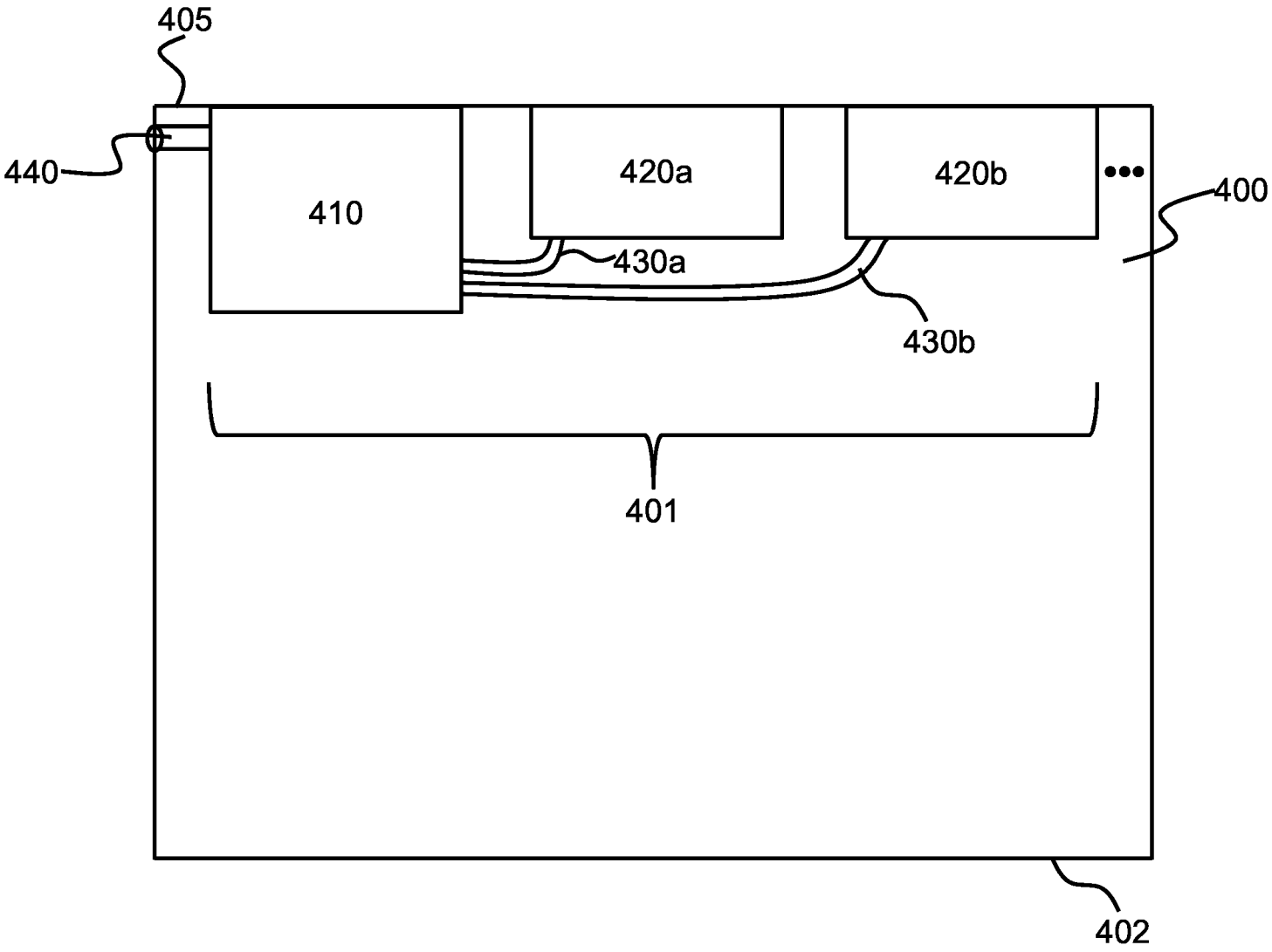
FIG. 4 shows an example of an installation space with a floor-saving multi-zone temperature control system, in accordance with embodiments of the invention.

FIG. 4 shows an example of an installation space 400 with a floor-saving multi-zone temperature control system 401.

The installation space 400 may include a top surface 405, such as a ceiling. The top surface may be flat or may be sloped. One or more walls or beams may support or meet the top surface. In one example, the installation space may be a closet, such as a clothing closet. The installation space may include a lower surface 402 such as a floor.

The temperature control system 401 may comprise a CU 410 and a plurality of FCUs 420*a*, 420*b*. The condenser unit and FCUs may be joined by respective connectors 430*a*, 430*b*.

The CU 410 may be located within an installation space. In some embodiments, the CU may be located at or near a top region of the installation space. This may include any location and characteristic as described elsewhere herein.

The CU may be connected to one or more water lines 440. The water lines may flow within the building to deliver water from a source within or outside the building. The water lines may be directly or indirectly coupled to a water main. The water lines may deliver water to the CU. The water lines may deliver any kind of cooling fluid.

The FCUs 420*a*, 420*b* may be located within an installation space. In some embodiments, the FCUs may be located at or near a top region of the installation space. This may have any location and characteristic as described elsewhere herein. The FCUs may be adjacent to one another. The FCUs may or may not come into contact with one another. In some instances, the FCUs may have sufficient space between one another to not vibrate against or bump into one another. For example, a gap of at least 1, 2, 3, 4, 5, 6, 7, 8, 9, 10, or more inches may be provided between FCU units. The FCU units may be provided in a row. In some embodiments, the condensing unit 410 and FCUs 420*a*, 420*b* may be provided within a single row. Alternatively, they may be positioned in scattered position, array, or any other configuration.

Two FCUs are illustrated by way of example. However, any number of FCUs may be provided for the temperature control system, as described elsewhere herein. Optionally, the FCUs may be connected to a single CU. A condenser unit of the temperature control system may be coupled to two or more FCUs.

Each FCU may comprise its own fan, as described elsewhere herein. This may allow for multiple temperature zones within a region that is heated or cooled by the temperature control system. Each FCU may correspond to a region of a space that is heated or cooled by the temperature control system. Thus, a single condenser unit may be able to support multiple FCUs, and thereby support multiple temperature zones. A user may be able to individually specify and control the temperature in the different temperature zones.

The CU 410 may be coupled to each of the FCUs 420 with aid of respective connectors 430*a*, 430*b*. Each connector may comprise one or more lines, such as one or more tubes. The connector may optionally be flexible. The connector may comprise one or more refrigeration lines. In some instances, each FCU may have its own connector to the CU. The connectors may optionally traverse a wall or ceiling of the installation space.

The temperature control system 401 may allow for multiple temperature zones to be controlled within a region of a building while also providing a compact temperature control system that does not take up too much usable space. For example, by having the entire temperature control system at or near a ceiling, the user is able to utilize the floor space and other regions of the installation space (e.g., closet, room). This may be while allowing the temperature control system to take up space near the ceiling, which is often not used anyway.

Further possible details of CUs and FCUs are provided elsewhere herein. Such details are provided by way of example only and are not limiting.

Figure 5:
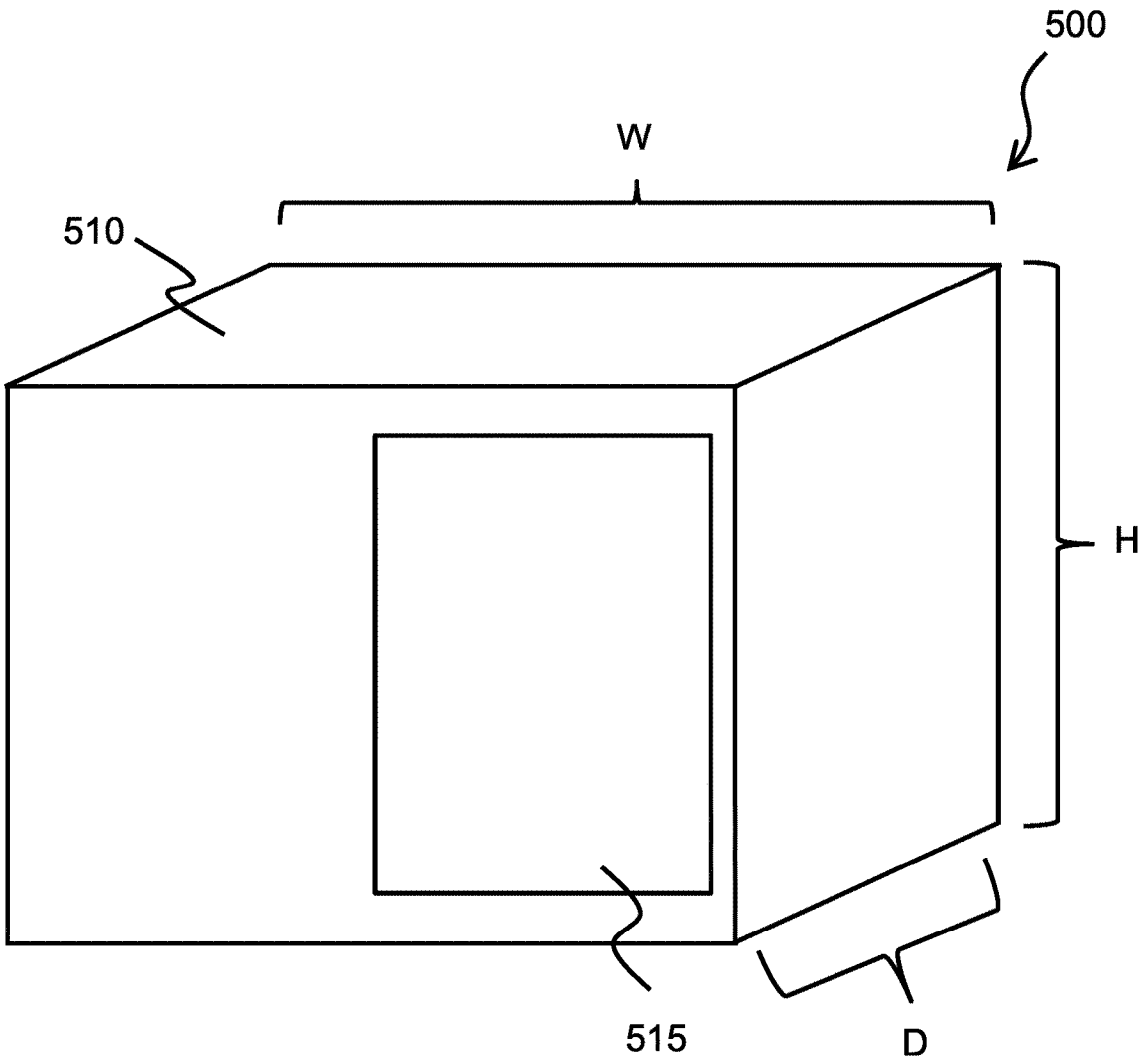
FIG. 5 shows an example of a condenser unit (CU), in accordance with embodiments of the invention.

FIG. 5 shows an example of a CU 500. The CU may also be referred to as a condensing unit, condenser or similar name. The CU may optionally be an R-410A CU. R-410A may be a zeotropic, but near azeotropic, mixture of difluoromethane (CH2F2, a.k.a. R-32) and pentafluoroethane (CHF2CF3, a.k.a. R-125). R-410A may be a refrigerant, which may be used in air conditioning appliances. The CU may utilize any other refrigerant with desired properties. Optionally, the CU may utilize R-22 or another refrigerant.

The CU may have any set of dimensions (e.g., width W, height H, depth D). For example, any of the dimensions may be 48 inches or less, 40 inches or less, 38 inches or less, 36 inches or less, 31 inches or less, 30 inches or less, 24 inches or less, 22 inches or less, 20 inches or less, 18 inches or less, 17 inches or less, 16 inches or less, 15 inches or less, 14 inches or less, 13 inches or less, 12 inches or less, 11 inches or less 10 inches or less, 9 inches or less, 8 inches or less, 7 inches or less, 6 inches or less, 5 inches or less, 4 inches or less, 2 inches or less, or 1 inch or less. In some embodiments, the width may be greater than the height. The height may be greater than the depth. In some instances, the depth may be the smallest dimension. In one example, a condensing unit may have dimensions of less than or equal to 38 inches wide by 17 inches high by 11 inches deep. In another example, the condensing unit may have dimensions of less than or equal to about 40 inches wide by 20 inches high by 12 inches deep. In some instances, the greatest dimension of the CU may be less than any of the values provided herein. In some instances, the smallest dimension (e.g., depth) of the CU may be less than any of the values provided herein. For instance, the smallest dimension may be less than 15 inches, 12 inches, 11 inches, 10 inches, 9 inches, 8 inches, 7 inches, 6 inches, 5 inches, 4 inches, 3 inches, 2 inches, or 1 inch.

The CU may weigh less than or equal to 3000 lbs, 2000 lbs, 1000 lbs, 500 lbs, 100 lbs, 80 lbs, 70 lbs, 60 lbs, 50 lbs, 40 lbs, 30 lbs, 20 lbs, 15 lbs, 10 lbs, 8 lbs, 6 lbs, 5 lbs, 3 lbs, or 1 lb. The CU may provide cooling of less than or equal to about 3 tons, 2.5 tons, 2 tons, 1.5 lbs, 1 ton, 0.5 ton, 0.1 ton of cooling. The maximum capacity of the CU may be less than any of the values provided herein. The CU may provide any level of cooling as provided herein, while maintaining any of the dimensions described. The CU may have a lower capacity than conventional commercial sized CUs. For instance, the CU may be about half of a typical capacity of such a conventional CU. The capacity of the CU may be sufficient to control a temperature of an apartment, such as an area with at least 1500 square feet, 1300 square feet, 1200 square feet, 1100 square feet, 1000 square feet, 900 square feet, 800 square feet, 700 square feet, 600 square feet, 500 square feet, 400 square feet, 300 square feet, or 200 square feet.

The CU may optionally comprise a housing 510. The housing may be a cabinet, which may optionally have one or more access panels 515. The CU may include one or more water compartments for condenser water and/or refrigeration piping connections. The water compartment may be contained within the housing of the CU. The compartments may or may not share a wall with the housing of the CU. The water compartment may have its own dedicated access panel. A user may be able to access the water compartment to empty the water or view the water level.

The CU may comprise a compressor. The compressor may be contained within a housing of the CU. The compressor may be accessed by opening the access panel. The CU may comprise a heat exchanger. The heat exchanger may be contained within a housing of the CU. The heat exchanger may be accessed by opening the access panel. The heat exchanger and compressor may share a compartment. The compartment for the heat exchanger and compressor may be fluidically isolated from the water compartment.

The CU may have any orientation. In some instances, the orientation may depend on the location where the CU is mounted. In one example, the CU may have a vertical orientation (where the height H of the CU is parallel to the direction of gravity) when the CU is supported by the floor, or near a bottom section of the installation space. In another example, the CU may have a horizontal orientation (where the depth D of the CU is parallel to the direction of gravity). This may optionally occur when the CU is supported by the ceiling. This horizontal orientation may occur when the CU is at or near the ceiling, or within any top region of the installation space. The horizontal installation when supported by the ceiling may allow the smallest dimension (e.g., depth D) to extend downward from the ceiling. Providing a rotation of the CU to a horizontal orientation may not be apparent when determining mounting positions, but the CU may be able to operate similarly when in a horizontal orientation and provide a desired low profile relative to the ceiling. When in a horizontal orientation, a user may still be able to open the access panel or panels. The access panel may optionally be provided on a surface opposite the surface contacting or facing the ceiling.

Figure 7:
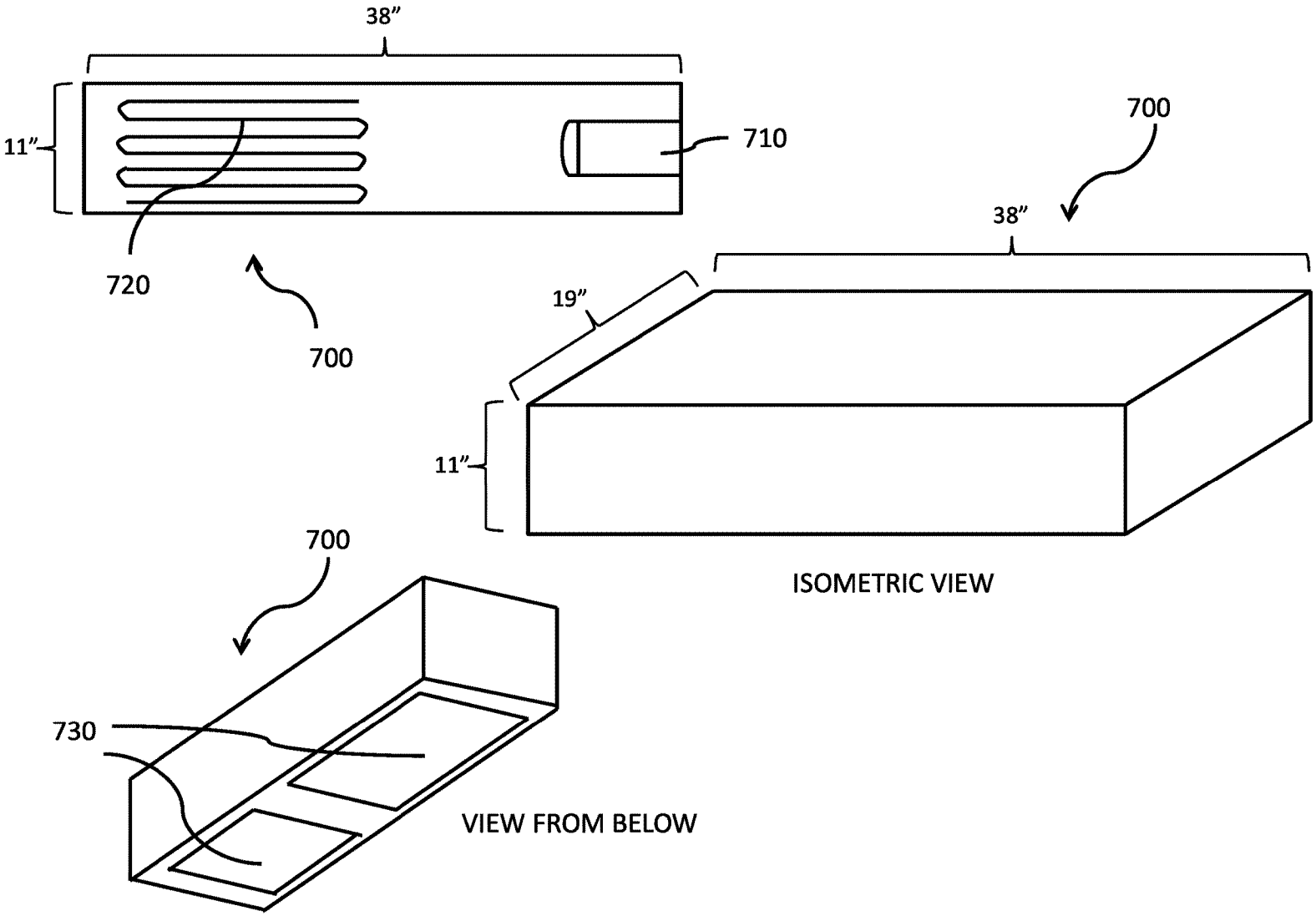
FIG. 7 shows an additional example of a condenser unit, in accordance with embodiments of the invention.

FIG. 7 provides additional views of a CU 700, in accordance with embodiments of the invention. The CU may be a horizontal CU as illustrated. The horizontal CU configuration may be provided when the CU is mounted on or near a ceiling. This may advantageously provide a low profile of the CU relative to the ceiling. The CU may comprise a compressor 710 and/or heat exchanger 720. The CU may comprise one or more access panels 730. The access panels may be provided on a lower surface of the CU to grant a user access when the CU is mounted on a near a ceiling. The CU may have the dimensions depicted, or any value less than the dimensions depicted. Such dimensions are provided by way of example only and are not limiting. The CU may have any combination of dimensions, which may include any of the values as described elsewhere herein.

Figure 6:
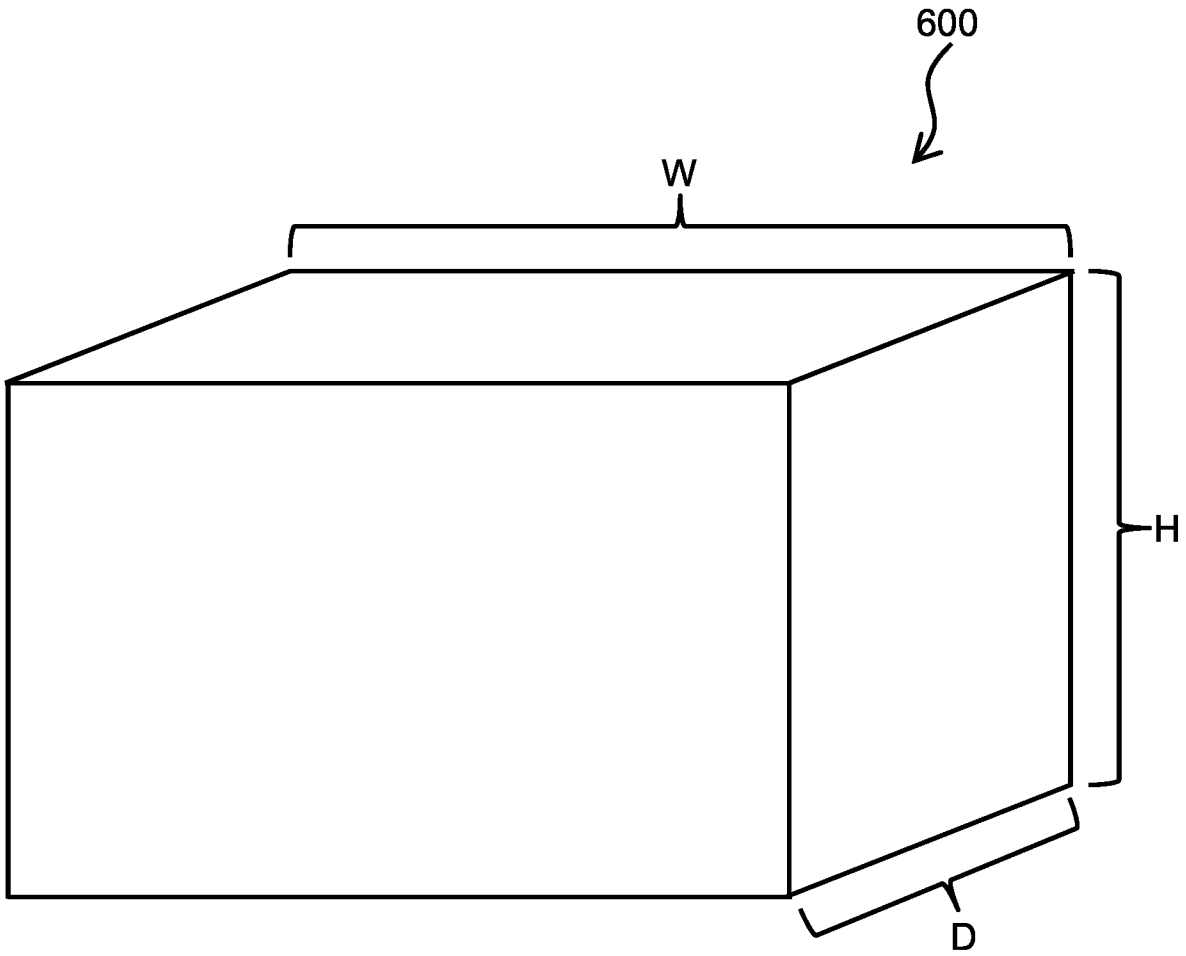
FIG. 6 shows an example of a fan coil unit (FCU), in accordance with embodiments of the invention.

FIG. 6 shows an example of a fan coil unit (FCU) 600. The FCU may comprise one, two, three, four or more fans. The FCU may optionally comprise a pair of fans. The fans may optionally be in-line, high-pressure fans. In some embodiments, when a single FCU is connected to a CU, a pair of fans may be provided for the FCU. Optionally, when multiple FCUs are connected to a single CU, a single fan may be provided for each FCU. The fans in different FCUs may be capable of operating independently of one another.

The FCU may comprise at least one filter rack for holding a filter. The filter rack may be configured to hold MERV 8 filters. In some embodiments, the filters may be MERV 13 or other similarly rated filters. The filters may be hospital-grade filters. The filters may be MERV 8 or higher, MERV 10 or higher, MERV 12 or higher, MERV 13 or higher, MERV 14 or higher, or MERV 15 or higher rated filters. The filter rack may be configured to hold any of such filters.

The FCU may comprise one or more couplings. The couplings may optionally be quick-connect couplings. The couplings may allow for easy installation and connection with one or more CU via one or more connectors (e.g., refrigeration lines).

The FCU may have a housing and one or more access panels. The access panels may allow access to internal components. The access panels may be located on a bottom surface of the FCU, optionally when the FCU is mounted onto a ceiling. The access panels may be located on sides of the FCU. The access panels may be located on a surface of the FCU opposite a surface that is mounted to the installation space. The access panels may be located on any exposed surface of the FCU. The access panels may provide easy access to a ceiling's plenum-mounted unit for maintenance.

The FCU may have any set of dimensions (e.g., width W, height H, depth D). For example, any of the dimensions may be 48 inches or less, 44 inches or less, 43 inches or less, 42 inches or less, 41 inches or less, 40 inches or less, 38 inches or less, 36 inches or less, 31 inches or less, 30 inches or less, 24 inches or less, 22 inches or less, 20 inches or less, 18 inches or less, 17 inches or less, 16 inches or less, 15 inches or less, 14 inches or less, 13 inches or less, 12 inches or less, 11 inches or less 10 inches or less, 9 inches or less, 8 inches or less, 7 inches or less, 6 inches or less, 5 inches or less, 4 inches or less, 2 inches or less, or 1 inch or less. In some embodiments, the width may be greater than the depth. The height may be lesser than the depth, and/or may be lesser than the width. In one example, a condensing unit may have dimensions of less than or equal to 43 inches wide by 11 inches high by 14 inches deep. In another example, the condensing unit may have dimensions of less than or equal to about 42 inches wide by 10 inches high by 14 inches deep. In some instances, the greatest dimension of the CU may be less than any of the values provided herein. In some instances, the smallest dimension (e.g., height) of the CU may be less than any of the values provided herein. For instance, the smallest dimension may be less than 18 inches, 15 inches, 14 inches, 13 inches, 12 inches, 11 inches, 10 inches, 9 inches, 8 inches, 7 inches, 6 inches, 5 inches, 4 inches, 3 inches, 2 inches, or 1 inch.

The FCU may weigh less than or equal to 100 lbs, 80 lbs, 70 lbs, 60 lbs, 50 lbs, 40 lbs, 30 lbs, 25 lbs, 20 lbs, 15 lbs, 12 lbs, 10 lbs, 8 lbs, 6 lbs, 5 lbs, 3 lbs, or 1 lb. The FCU may be capable of operating in conjunction with a CU having the characteristics as described elsewhere herein. The condenser unit may be capable of supporting multiple FCUs having the characteristics described herein.

The FCU may have any orientation. In one example, the CU may have a horizontal orientation (where the height H of the CU is parallel to the direction of gravity). This may optionally occur when the CU is supported by the ceiling. This horizontal orientation may occur when the CU is at or near the ceiling, or within any top region of the installation space. In some instances, the smallest dimension of the FCU (e.g., height H), may be extending from the ceiling. This may allow the FCU to have a low profile relative to the ceiling.

In some embodiments, the entirety of the temperature control system may be ceiling-mounted. The entirety of the temperature control system may be located at or near the top of the installation space. The entirety of the temperature control system may fit within 24 inches, 22 inches, 20 inches, 18 inches, 16 inches, 15 inches, 14 inches, 13 inches, 12 inches, 11 inches, 10 inches, 9 inches, 8 inches, 7 inches, 6 inches, 5 inches, 4 inches, 3 inches, 2 inches, or 1 inch of the ceiling. The temperature control system may optionally not hang below any of the values provided herein. This may allow the temperature control system to have a relatively low profile from the ceiling, and be less intrusive to the installation space (e.g., closet space).

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents

What is claimed is:

1. A temperature control system, configured to be installed within an installation region comprising a ceiling, said system comprising:

at least one fan coil unit (FCU) configured to be suspended downward from the ceiling and located below the ceiling, said FCU comprising at least one fan; and at least one condenser unit (CU) configured to be suspended downward from the ceiling, said CU comprising at least a heat exchanger and a compressor, wherein said CU is coupled to the FCU with aid of at least one connector, and wherein said CU has a height smaller than 9 inches, wherein the at least one CU is configured to have a maximum capacity of 3 tons cooling or less, and wherein the temperature control system is configured to be deposited with a lower boundary of the temperature control system below the ceiling by less than 10 inches from the ceiling in its entirety, wherein an upper boundary of the installation region is below the ceiling and the entire temperature control system is located within the installation region.

2. The system of claim 1, wherein the CU is configured to be connected to a water system of a structure comprising the installation region.

3. The system of claim 1, wherein the connector comprises one or more tubes.

4. The system of claim 1, wherein the connector comprises one or more refrigeration lines.

5. The system of claim 1, wherein the FCU and the CU do not contact a floor of the installation region.

6. The system of claim 1, wherein the installation region is a closet.

7. The system of claim 1, wherein a combination of the FCU and the CU have a footprint of less than or equal to 6 square feet.

8. The system of claim 1, wherein a height of the CU is less than or equal to a width and a length of the CU.

9. The system of claim 1, wherein the CU is configured to be deposited in a horizontal orientation to provide the height to extend down from the ceiling by less than 9 inches.

10. The system of claim 1, wherein the FCU is configured to be deposited with a lower boundary of the FCU below the ceiling by less than 2 inches from the ceiling.

11. A temperature control system, configured to be installed within an installation region comprising a ceiling, said system comprising:

a plurality of fan coil units (FCUs) configured to be suspended downward from the ceiling and located below the ceiling, each FCU comprising at least one respective fan; and at least one condenser unit (CU) configured to be suspended downward from the ceiling, said CU comprising at least a heat exchanger and a compressor, wherein said CU is coupled each of said FCUs with aid of at least one respective connector, and wherein said CU has a height smaller than 9 inches, wherein the at least one CU is configured to have a maximum capacity of 3 tons cooling or less, and wherein the temperature control system is configured to be deposited with a lower boundary of the temperature control system below the ceiling by less than 10 inches from the ceiling, wherein an upper boundary of the installation region is below the ceiling, and the entire temperature control system is located within the installation region.

12. The system of claim 11, wherein the CU is located at or near a bottom of the installation region.

13. The system of claim 11, wherein the CU is located at or near a ceiling of the installation region.

14. The system of claim 11, wherein respective fans of each FCU operate independently of one another.

15. The system of claim 11, wherein the plurality of FCUs are coupled to a single CU of the at least one CU with aid of a connector.

16. The system of claim 11, wherein the temperature control system is mounted below the ceiling.

17. The system of claim 11, wherein the CU is configured to be deposited in a horizontal orientation to provide the height to extend down from the ceiling by less than 9 inches.

18. The system of claim 11, wherein the plurality of FCUs is configured to be deposited with a lower boundary of each FCU of the plurality below the ceiling by less than 2 inches from the ceiling.

19. The system of claim 11, wherein the temperature control system is configured to control temperature within multiple temperature zones that are independent of one another.

20. The system of claim 19, wherein each temperature zone corresponds to a respective FCU of said plurality.

* * * * *